United States Patent [19]

Wagner et al.

[11] Patent Number: 4,854,020

[45] Date of Patent: Aug. 8, 1989

[54] PROCESS FOR TREATMENT OF FILAMENT CABLE

[75] Inventors: Wolfram Wagner; Dieter Paulini; Peter Widder, all of Dormagen, Fed. Rep. of Germany

[73] Assignee: Bayer Aktiengesellschaft, Fed. Rep. of Germany

[21] Appl. No.: 145,574

[22] Filed: Jan. 19, 1988

[30] Foreign Application Priority Data

Jan. 29, 1987 [DE] Fed. Rep. of Germany ..... 3702543

[51] Int. Cl.[4] ..... D02G 1/12; D02G 1/16

[52] U.S. Cl. ..... 28/255; 28/267

[58] Field of Search ..... 28/255, 266, 267, 281

[56] References Cited

U.S. PATENT DOCUMENTS

| | | | |
|---|---|---|---|
| 2,874,446 | 2/1959 | Sellers | 28/266 |
| 2,924,001 | 2/1960 | Gundlach | 28/266 |
| 3,166,820 | 1/1965 | Taul et al. | 28/266 |
| 3,343,240 | 9/1967 | Parmeggiani et al. | 28/255 |
| 3,887,969 | 6/1975 | Erickson et al. | 28/266 |
| 3,908,248 | 9/1975 | Schmid et al. | 28/255 |
| 4,014,084 | 3/1977 | Bauer et al. | 28/255 |
| 4,100,659 | 7/1978 | Bauer et al. | 28/255 |
| 4,103,404 | 8/1978 | Backer et al. | 28/255 |
| 4,115,907 | 9/1978 | Lawson et al. | 28/266 |
| 4,571,765 | 2/1986 | Okada et al. | 28/266 X |
| 4,622,195 | 11/1986 | Bueb et al. . | |
| 4,760,629 | 8/1988 | Paulini et al. | 28/281 X |

FOREIGN PATENT DOCUMENTS

| | | | |
|---|---|---|---|
| 3308657 | 9/1984 | Fed. Rep. of Germany . | |
| 54-2450 | 1/1979 | Japan | 28/255 |
| 999650 | 7/1965 | United Kingdom | 28/267 |
| 2024273 | 1/1980 | United Kingdom | 28/255 |

*Primary Examiner*—Robert R. Mackey

*Attorney, Agent, or Firm*—Connolly and Hutz

[57] ABSTRACT

Filament cables are crimped and the crimp cake of the filament cable obtained is passed over a gas permeable screen plate while gas flows to the bottom of the cake from flow through the screen plate so that the cake can be moved over the plate without making contact therewith or with reduced contact force and can be treated during its residence over the screen plate.

2 Claims, 3 Drawing Sheets

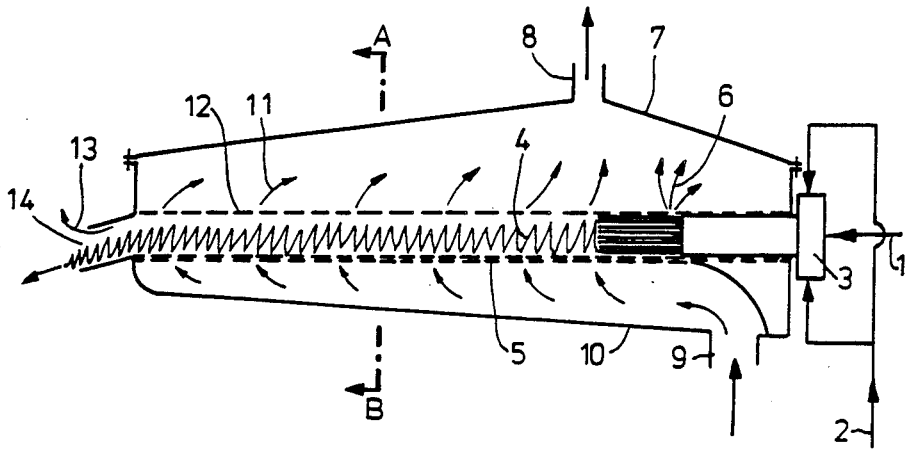
FIG. 1
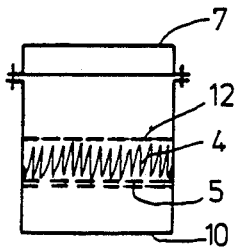
FIG. 2 (A-B)

(C-D)

PROCESS FOR TREATMENT OF FILAMENT CABLE

BACKGROUND OF THE INVENTION

This invention relates to a process for the treatment of a filament cable in an apparatus into which it is introduced and in which it is treated and from which it is carried out, and to the apparatus itself.

Filament cables are generally subjected to various treatments such as drying, relaxation and thermo-setting, especially after they have been washed, stretched or scrooped, for example in order that they may acquire a certain moisture content and certain properties such as elongation, strength or dye absorption. In addition, such filament cables are normally crimped in order to prevent their falling apart into individual filaments and/or in order to ensure, in the case of staple fibres, that they will adhere sufficiently firmly to one another for the subsequent spinning process. The various treatments such as drying, relaxation and thermo-setting are normally carried out by treating the filament cable with a gas, in particular with steam or heated air. These steam treatments and drying processes require certain residence times to be observed.

In conventional after-treatment processes carried out at low production rates of up to 150 m/min and with heavy filament cables, for example of 100 ktex, the requisite residence times are obtained by using screen drum driers comprising a series of screen drums, for example 20 to 30 drums each having a diameter of 140 cm. Drying is carried out with heated air which must flow at a rate of 3 to 5 m/sek if sufficient drying is to be achieved. The energy requirement for this is considerable. Since residues of solvent or of monomer are invariably expelled from the filament cable during the steam treatment or dying, it is necessary to insulate the drying apparatus from the surroundings, but this can only be incompletely achieved in the case of a screen drum drier. Crimping is generally carried out after drying.

As an alternative, so called screen belt driers are known, on which the product is deposited along a meandering line and with little tension and is transported in this form through the treatment zones. The low tension, in fact in most cases tension free deposition of the material on the screen belt has the disadvantage that the layers of folded cable which are the first to be deposited lie at the bottom and are progressively covered by layers of products subsequently deposited so that when the cable is drawn off the screen belt a large part of the cable has to be pulled out from under the rest of the cable. This may lead to entanglement of the layers and felting which may interfere with the smooth running of the process. To overcome this disadvantage, the cable must be deposited on so called turning drums before its introduction into the steam treatment or drying apparatus so as to ensure that when the cable is deposited on the screen belt, those layers which are laid down first will come to lie at the top and can easily be drawn off.

One disadvantage of this complicated technique is that the apparatus is difficult to seal off at the product inlet end, with the result that large quantities of excess air are drawn into the apparatus and are unnecessarily heated up and may impair the purity of the treatment gas, and harmful substances are liable to escape through the leakages. There is the further disadvantage that the turning drum cools the cable and thereby entails an energy loss.

For the steam treatment/relaxation of staple fibre/flock, it is known to use screen belt steamers in which the material together with a relatively large quantity of air is introduced into the treatment zone by means of the screen belt and is steamed in this zone by the circulation of super heated steam. The disadvantages of this apparatus lie in the difficulty of sealing it off combined with the indefinite steam concentrations and the large amount of time required, for example when a colour change is carried out.

SUMMARY OF THE INVENTION

It is an object of the present invention to provide an improved treatment process, in particular for crimping filament cables having cable weights of from 5 to 500 ktex with little consumption of energy and reduced emission and for treating these cables, in particular by steaming, relaxation, drying and/or fixing.

The present invention relates to a process for the treatment of a filament cable in a treatment apparatus, characterized in that the filament cable is introduced into the treatment apparatus through a crimping device, for example a known mechanical or special aerodynamic crimping device, and is crimped to form a crimp cake of the filament cable which is transported over a gas permeable screen plate which is preferably stationary and which is preferably horizontal or slightly inclined, while gas is conveyed to the crimp cake from below through the screen plate so that the cake can be transported over the plate without making contact therewith or with reduced contact force, and the crimp cake is treated in the desired manner during its residence over the screen plate and the treated cake finally leaves the treatment apparatus.

Preferred cross-sectional forms of the crimped cake are greater in length than in height, for example they may be oval, eliptical or rectangular. Crimping is preferably carried out in an aerodynamic crimping device by means of a hot gaseous medium at a pressure of from 5 to 16 bar and a temperature of from 50° to 210° C. Preferred crimping devices are disclosed in DE-A-3 308 657 (U.S. Pat. No. 4,622,195). The crimping nozzle employed may be treated with steam or suitably tempered air. The end wall in which it is mounted may be the closing wall of a preceding apparatus which is used, for example, for washing, stretching or scrooping. The crimping nozzle preferably comprises an inlet part, a mixing zone, a diffuser and a cage of rods. In one particularly preferred embodiment, the effective opening of the crimping nozzle is rectangular. The filament cable opens up inside the diffuser and is then stopped in the cage of rods and crimped. The rod cage preferably consists of rods which are arranged with their axes parallel and spaced apart so that the gas can escape through the gaps between them.

The present invention further relates to an apparatus for the treatment of a filament cable, characterized by an inlet nozzle for the introduction of the filament cable, adjacent to said nozzle a cage of rods placed parallel to the direction of transport, a gas permeable screen plate as a continuation of the lower edge of the outlet opening of the nozzle, an outlet opening for the treated material, a gas conveying device for the injection of gas underneath the screen plate and the removal of gas above the material by suction, and a housing enclosing the nozzle up to the outlet opening. In a preferred embodiment, the internal dimensions of the housing progressively diminish to the outlet opening.

The treatment apparatus proper preferably consists substantially of an elongated channel having a cross-sectional form adapted to the cross-section of the crimp cake and having a perforated single or double bottom for the uniform distribution of flow in the longitudinal and transverse direction, and below this a gas distribution chamber, e.g. one which is triangular in profile, and above this a plane or funnel shaped gas collecting hood. The mechanical and aerodynamic crimping device is mounted gas tightly in one end face and forms the product inlet gate. Opposite this device is situated an opening for the outlet of product. Above the product may be arranged another gas permeable screen plate or, alternatively, so called rocker-shaped holding down devices arranged in the longitudinal direction to prevent "bulging" of the crimp cake from its longitudinal form. Other components of the apparatus include the pipes, ventilators, heat exchangers, throttle devices and insulations which maintain the gas circulations at the required temperature and at the same time keep the product which is in the form of a crimp cake virtually afloat. Due to the floating state of the product, the crimping device need only produce a slight thrust but this thrust may be reinforced or reduced by means of special perforated screen plates known per se with selectable gas outlet direction.

The treatment apparatus may be sub-divided into several treatment zones. In the individual treatment zones, the treatment medium, which is preferably steam or air, may be kept in circulation over a heat exchanger and the product by a ventilator.

A particularly preferred process is characterized in that the injected gas is drawn off/above by a ventilator above the crimp cake which is transported over the screen belt and this gas is passed over a heat exchanger and through restrictor valves to be reintroduced into the treatment zone from below, i.e. it is circulated and several such circulations may be placed in a row in the form of zones. If cooling zones are provided, these do not require a heat exchanger and may be operated with fresh air for cooling. If the apparatus is used as dryer, a stream of fresh air may be superimposed on the internal circulations to flow in the opposite direction to the crimp cake of the filament cable. This stream of fresh air cools the crimp cake in the cooling zones and at the same time becomes heated. In its passage through the dryer, it becomes charged with moisture from the crimp cake and is drawn off in the first drying zone by means of a ventilator. If the apparatus is operated as a steamer, the nozzle may be operated with steam. The crimping steam may in that case be used for the steam treatment as well, preferably flowing in the same direction as the crimp cake. If a mechanical crimping device is used, the steam may be introduced at any point either in counter flow or in direct flow. In this case, cooling is again carried out as a final treatment. The apparatus may also be used for a combined steaming and drying treatment, in which case an intermediate zone is advantageously placed between the steaming zone and the drying zone. Situated at the end of the apparatus is an opening through which the filament cable is removed from the apparatus, optionally to be conveyed to another apparatus, for example a cutting or plaiting device.

One main advantage of a stationary screen plate is that the apparatus can be exceptionally efficiently sealed off and there are no rotating parts on which the cables are liable to get caught. Furthermore, since there is so little leakage air, the effectiveness and purity of the treatment gases are improved and careful and uniform treatment of the filament is ensured. The crimping process converts the stretched filament cable into a compressed crimp cake which is circular, oval or rectangular in cross-section. The compression factor, defined as the ratio of the velocity of the filament cable to the velocity of the crimp cake, is preferably in the range of from 2 to 100, in particular from 2 to 25.

Due to the enormous reduction in speed of the filament, it is possible to achieve speeds of transport of from 0.2 to 5 m/min so that relatively small apparatus with high residence times, for example of from 2 to 15 minutes, may be employed. The compression enables surface weights of from 1.5 to 20 kg/m to be realized. This ensures very careful and uniform treatment with low gas velocities of only 0.3 to 3 m/sek.

According to a preferred embodiment, the filament cable enters the treatment apparatus at a velocity of from 50 to 150 m per minute and leaves the apparatus, crimped and treated, at a velocity of from 2 to 5 m per minute.

If gaseous medium is used for the treatment, preferably steam or hot air, it is advisable to pass this from below upwards through the screen plate and the crimped cake.

The process according to the invention is suitable mainly for all endless filament cables which are required to be subjected to hydrothermal gas treatments. The process is particularly effective for the treatment of acrylic filament cables preferably produced by the dry spinning process.

The process according to the invention is particularly suitable for those endless filament cables which are obtained in a wide form, e.g. from 50 to 500 mm. by conventional after treatment stages such as washing, stretching, scrooping and/or drying, in which (a) The washing process is carried out in several stages by the counter flow method and a vibrating trough or flat baths with deflecting rollers or screen drums are used as conveyor devices for the spinning band during the washing process, (b) Stretching is carried out before and/or after the washing process, in an atmosphere of steam at 100° to 120° C. or in a water bath at 70° to 98° C., (c) Crimping is carried out in the aerodynamic crimping device indicated above, using a hot, gaseous medium at a pressure of from 5 to 16 bar and a temperature of from 50° to 210° C. or a known mechanical flat compression crimping chamber, (d) The dressing is applied continuously to the filament cable before, during or after crimping, (e) For the steaming treatment, the filament cable is transported in a folded form and with little tension over the screen plate to pass through a steaming apparatus in which it is treated with steam at 100° to 150° C., and (f) The filament cable is finally dried in the folded state over the screen plate by means of air heated to 60° to 180° C. and is then cooled to temperatures below 50° C. by means of cold air and optionally conveyed to a cutting device or packaging unit.

The cut fibers may be continuously transported from the cutting device to a baling press in a pneumatic conveyor duct to be compressed into completely packaged fiber bales.

The filament cables may in principle have any of a wide variety of chemical compositions and be produced by a wide variety of processes. In one particularly preferred embodiment, the filament cable consists of a polyacrylonitrile optionally together with other copolymers and has been produced from a suitable solvent, e.g. dimethylformamide, by the dry spinning process.

DETAILED DESCRIPTION OF THE DRAWING

FIG. 1 represents a longitudinal section through a preferred apparatus in which the process according to the invention may be carried out.

The filament cable 1 is conveyed to the crimping device 3 which is supplied with air or steam through the duct 2. The filament cable is formed into a crimp cake 4 in this crimping device and pushed over the stationary screen plate 5. The current of gas 6 flowing out of the crimping device into the treatment apparatus is collected in the hood 7 together with the circulating current 11 and is passed through the duct 8 to various apparatus (not shown) such as heat exchangers, ventilators and restrictor devices to be returned to the channel 10 through the pipe 9 underneath the screen plate 5 and in this channel the gas impinges uniformly on the screen plate 5. Another screen plate 12 or rocker shaped holding down devices 12' may be arranged above the crimp cake.

After the crimp cake 4 has travelled through the treatment zone, it passes through the opening 14 together with a partial stream 13 of the treatment gas to leave the apparatus and may then be conveyed to, for example, a cooling or conveyor belt (not shown).

FIG. 2 is a cross-sectional view through A–B of the apparatus described above.

FIG. 3 shows an alternative apparatus equipped with a known mechanical crimping device. The filament cable 1 is conveyed to the crimping chamber 16 from the crimping rollers 15 and is pushed into the treatment apparatus as a crimp cake 4. This treatment apparatus resembles that of FIG. 2 in comprising a single or double screen plate 5, a hood 7', the outlet and inlet pipes 8 and 9 and the channel 10. Alternatively, three rocker shaped holding down devices 12' may be arranged above the crimp cake 4. The treatment gas (air or steam) may in that case be introduced through a connecting pipe 17 in the duct 9.

FIG. 4 is a corresponding cross-sectional view through C–D of the apparatus of FIG. 3.

The crimping nozzle shown in FIG. 5 consists of an inlet part (21), the mixing zone (25), the diffuser (26), and the cage of rods (27). The filament cable (1) is sucked in through the mouthpiece (30). A hot gas (29) is introduced through the supply pipe (22) and the gap (23) to heat and transport the filament cable.

EXAMPLE 1

Figure 3:
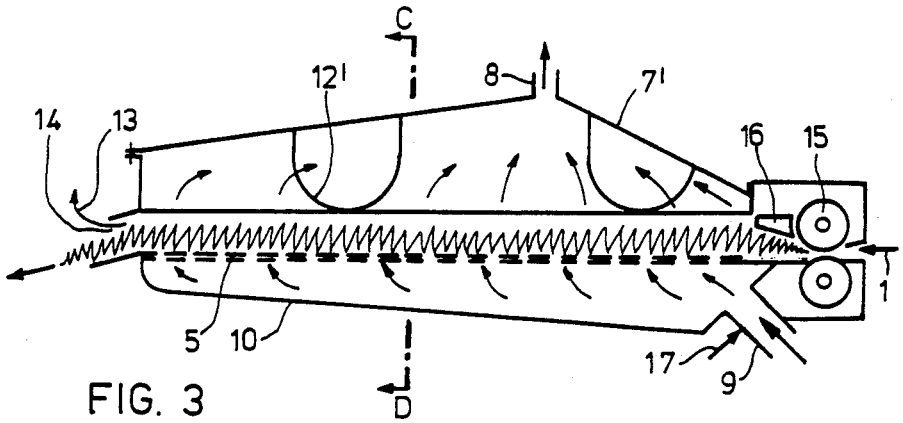
Figure 4:
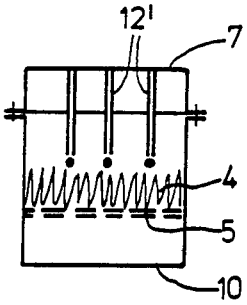
Figure 5:
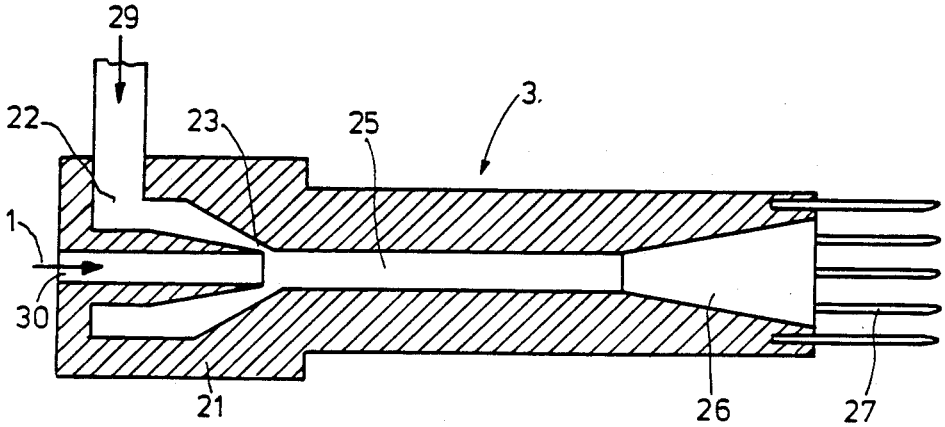
Figure 6:
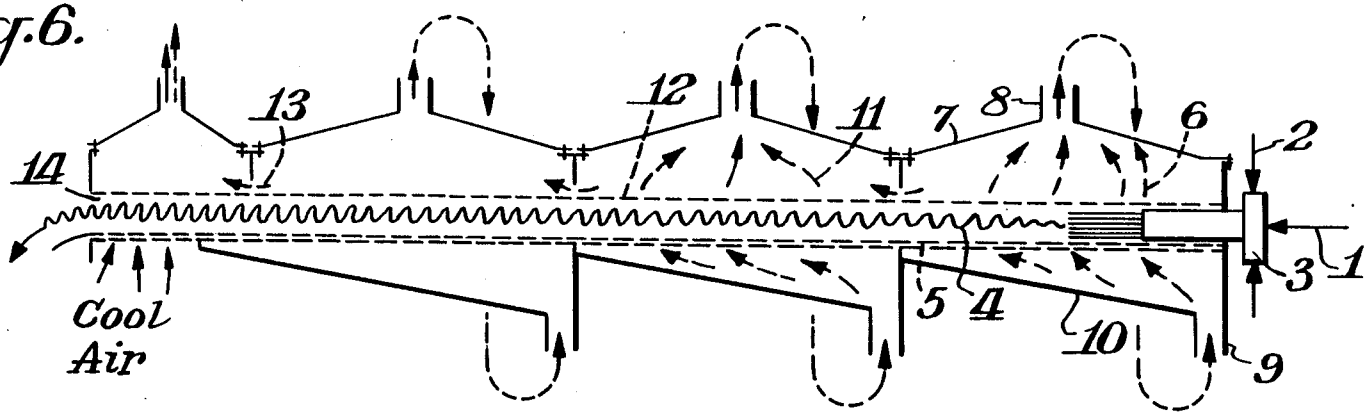
FIG. 6 illustrates the apparatus with a plurality of zones wherein the gas treatment method is used several times in several treatment zones and wherein a cooling zone is provided at the outlet end of the apparatus.
Figure 7:
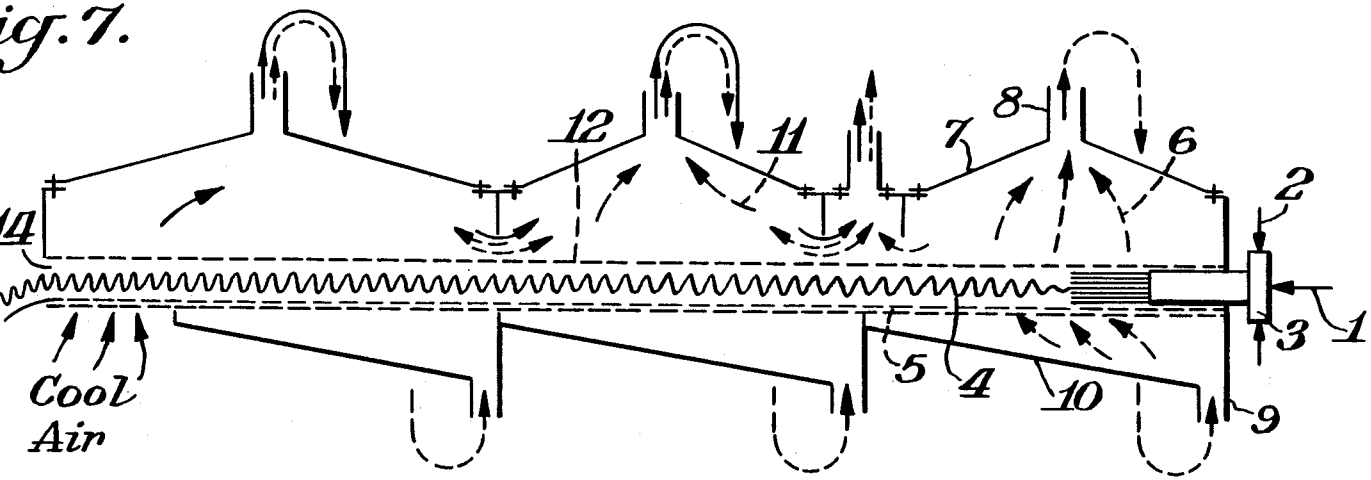
FIG. 7 illustrates apparatus where fresh air at the outlet end is introduced and countercurrently flows through the plural zones where the filament cable is dried by internal circulations and wherein wet air moisture and air are drawn off in the first drying zone.

A polyacrylic filament cable having a weight of 70 ktex is conveyed at the rate of 20 m/min to a nozzle operated with steam at 9 bar and 170° C. and is shaped by this nozzle into a crimp cake having a width of 125 mm and a height of 25 mm and a weight per unit area of 10 kg/m$^2$. The crimp cake is kept afloat for 3 minutes by super-heated steam supplied from below at a temperature of 125° C., a concentration of 98% and a velocity of 0.85 m/sek and the cake is passed through the treatment zone. Under the conditions mentioned above, the boiling shrinkage of the filament cable is reduced from 23.1 to 0.9% and the solvent loss is reduced from 3.3 to 1.7%. The strength of the filaments is reduced from 2.7 to 2.4 cN/dtex and the elongation increases from 26.4 to 40.4%. The moisture of the filament cable decreases from 50 to 35%.

EXAMPLE 2

A filament cable of 80 ktex is conveyed at the rate of 60 m/min to the crimping nozzle which is operated with hot air at 180° C. and 5 bar. The resulting crimp cake, 125 mm in width and 30 mm in height, is subjected to a current of air impinging on it from below at 160° C. and 0.9 m/s for two minutes and the cake is conveyed through the apparatus. The crimp cake, which has a weight per unit area of 12 kg/m$^2$, dries from a moisture content of 45% to 15%, based on the solids content.

We claim:

1. A process for treating a filament cable of from 5 to 500 ktex in a treatment apparatus that includes an enclosed chamber comprising the steps of introducing the filament cable into the enclosed chamber of the apparatus through an aerodynamic crimping device mounted gas tight at one endface of the enclosed chamber and forming a product inlet gate, crimping the filament cable to form a crimp cake with a compression factor of 2–100, passing the crimp cake through the enclosed chamber with a transport speed of 0.2 to 5 m/min over a gas permeable, stationary and horizontal screen bottom plate having perforations therein, impinging gas on the crimp cake from a gas distribution chamber below the bottom plate by flowing the gas through the plate with a gas velocity of 0.3 to 3 m/sec, moving the cake over the plate with minimum contact therewith, treating the crimp cake during a residence time of 2–15 minutes over the plate, and removing the treated crimp cake with surface weights of 1.5 to 20 kg/m from the enclosed chamber of the treatment apparatus, and wherein the enclosed chamber of the treatment apparatus is subdivided into several treatment zones and the gas treatment medium is drawn off by a ventilator above the crimp cake, passing the withdrawn gas treatment medium over a heat exchanger and through restrictor valves, reintroducing the medium into the treatment zone from below in order to maintain the crimp cake minimum contact with the plate and wherein the treatment zones include cooling zones provided with fresh air introduced in counter-current fashion.

2. A process according to claim 1, wherein the fresh air is superimposed on the internal circulations to flow in opposite direction to the crimp cake, charging the fresh air with moisture and drawing off the air in a first drying zone by means of a ventilator.

* * * * *